US005280911A

United States Patent [19]

Katayama

[11] Patent Number: 5,280,911

[45] Date of Patent: Jan. 25, 1994

[54] CLUBHEAD FOR GOLF IRON CLUB

[75] Inventor: Yutaka Katayama, Tokyo, Japan

[73] Assignee: Maruman Golf Kabushiki Kaisha, Tokyo, Japan

[21] Appl. No.: 787,925

[22] Filed: Nov. 7, 1991

[30] Foreign Application Priority Data

Nov. 9, 1990 [JP] Japan ..... 2-302680

[51] Int. Cl.[5] ..... A63B 53/04

[52] U.S. Cl. ..... 273/167 A; 273/167 E

[58] Field of Search ..... 273/167–175, 273/80 R, 77 R, 77 A, 162 D, 162 E, 162 F, 32 F

[56] References Cited

U.S. PATENT DOCUMENTS

| | | | |
|---|---|---|---|
| D. 184,054 | 12/1958 | Huthsing | 273/167 A |
| D. 212,293 | 9/1968 | Brown | 273/167 A |
| 1,089,881 | 3/1914 | Taylor | 273/167 A |
| 1,128,288 | 2/1915 | Churchill | 273/167 A |
| 1,945,844 | 2/1934 | Young | 273/167 A |
| 3,719,359 | 3/1973 | Evans et al. | 273/167 A |
| 3,810,631 | 5/1974 | Braly . | |
| 3,830,503 | 8/1974 | Consoli | 273/167 A |
| 3,862,759 | 1/1975 | Evans et al. | 273/167 A |
| 4,795,158 | 1/1989 | Kuykendall | 273/164 |
| 4,938,470 | 7/1990 | Antonious . | |

FOREIGN PATENT DOCUMENTS

| | | | |
|---|---|---|---|
| 24834 | of 1904 | United Kingdom | 273/167 A |
| 10736 | of 1905 | United Kingdom | 273/167 A |
| 1078412 | 8/1967 | United Kingdom | 273/167 E |
| 1204305 | 9/1970 | United Kingdom . | |
| 2012597 | 8/1979 | United Kingdom | 273/167 E |
| 1552341 | 9/1979 | United Kingdom . | |

*Primary Examiner*—V. Millin
*Assistant Examiner*—Sebastiano Passaniti
*Attorney, Agent, or Firm*—Armstrong, Westerman, Hattori, McLeland & Naughton

[57] ABSTRACT

A club head for a golf iron club comprises a head body having an inclined face, a back, and a sole, and heel and toe ends. A neck is connected in one piece with the head body at the heel end thereof for attaching thereto a club shaft. The head body is provided at the intersection of the face and sole thereof with a knife-edged leading edge.

1 Claim, 2 Drawing Sheets

CLUBHEAD FOR GOLF IRON CLUB

BACKGROUND OF THE INVENTION

1. Field of the Invention

The present invention relates generally to a clubhead for a golf iron club. More particularly, the invention relates to a clubhead for a golf iron club suitable for hitting a golf ball existing in a bad place such as thick rough or divot in which the clubhead is apt to get a large contact resistance from the grass or the ground at the time of hitting the ball.

2. Description of Related Art

Golf iron clubs have been used to hit a golf ball at various places such as teeing ground, fair way ground, rough, bunker, divot or the like, under various conditions. In the case that a golf ball exists on a teeing ground or fair way ground which generally provide a good situation or condition for good swing, it is easy to execute an accurate shot. On the other hand, in the case that a golf ball exists in a bad place such as thick rough or deep divot, the head or neck of a golf iron club is apt to get wrapped or caught with the grass when the iron club is swung through the rough, and it is therefore difficult to execute an accurate shot due to rotation of the clubhead during the swing of the club through the grass.

SUMMARY OF THE INVENTION

Accordingly, it is an object to provide a clubhead for a golf iron club which makes it possible to swing accurately and easily the golf iron club through rough or any other obstacles and thereby to hit accurately a golf ball even when the golf ball is nestled in a thick rough or deep divot.

The object of the invention can be achieved by a clubhead for a golf iron club which comprises a head body having an inclined face, a back, a sole, and heel and toe ends, the head body being formed at the intersection of said face and sole thereof with a leading edge in the form of knife edge.

In the clubhead according to the present invention, the knife-edged leading edge can easily cut through any obstacles such as grass in a thick rough or turf surrounding a divot when the club is swung through such obstacles, thereby making it possible to swing the club through such obstacles with less contact resistance. For example, when the club is swung down in the thick grass, the knife-edged leading edge can serves to prevent the grass from getting wrapped around the clubhead and thereby to prevent rotation of the clubhead or reduction of the head speed. Accordingly, the clubhead makes it possible to swing accurately and easily the golf iron club through rough or any other obstacles and thereby to hit accurately a golf ball even when the golf ball is nestled in a thick rough or divot.

Preferably, the head body is further formed with a plurality of vertical ribs which project backward from the back of the head body in substantially parallel to each other, each of the vertical ribs having a bottom side which is continuously connected to the sole of the head body so as to provide an additional sole on the clubhead.

The vertical ribs serve to reinforce the head body. Since the vertical ribs project backward from the head body, the depth from the face to the center of gravity of the clubhead is increased, and accordingly, moment of inertia of the clubhead about the center of gravity thereof is increased, thereby preventing rotation of the face at the time of striking a ball. The vertical ribs also serve to easily pass most of the grass in the rough through gaps therebetween and thereby to make it easy to swing the clubhead through the rough.

More preferably, the head body is further provided with a horizontal rib which projects from the back of the head body and extends perpendicularly to the vertical ribs. Also the horizontal rib serves to reinforce the head body. The horizontal rib further serves to control the height from the sole of the head body to the center of gravity of the clubhead by adjusting the height of the rib.

More preferably, the head body is further provided at the heel end thereof with a neck for attaching thereto a club shaft, and the neck is formed with a knife-edged ridge which projects forward from the front side thereof and is continuously connected to the knife-edged leading edge of the head body.

The knife-edged ridge formed on the front side of the neck serves to prevent the grass from getting wrapped therearound, thereby making it easy to pass the clubhead through thick rough.

Further objects, features and advantages of the present invention will become apparent from the following description of the preferred embodiments of the present invention as illustrated in the accompanying drawings.

DESCRIPTION OF THE PREFERRED EMBODIMENTS

Figure 1:
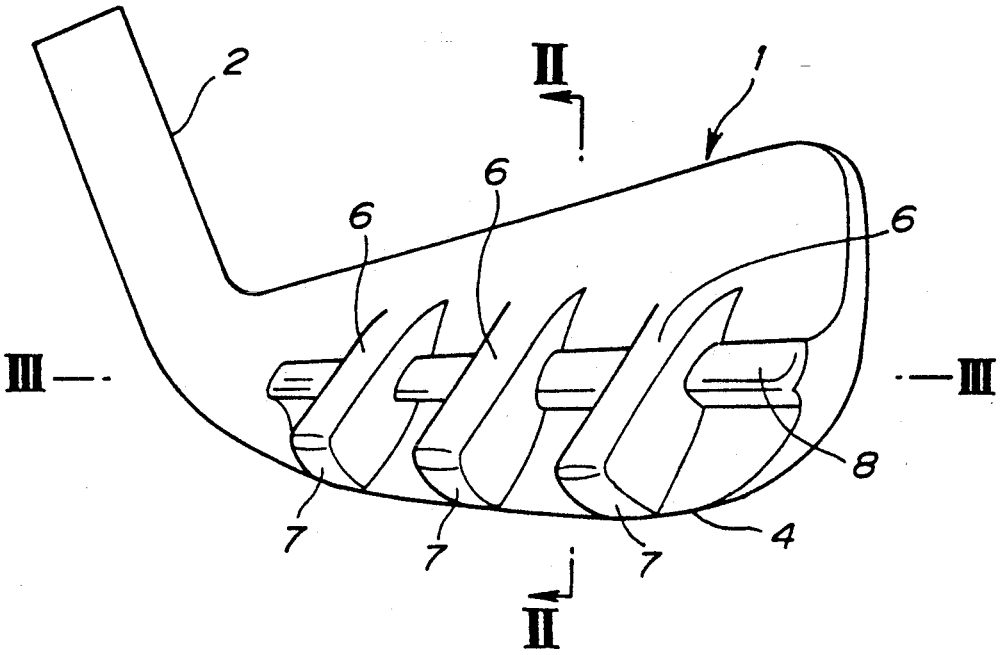
FIG. 1 is a perspective view of a golf iron clubhead showing a first embodiment of the present invention.
Figure 2:
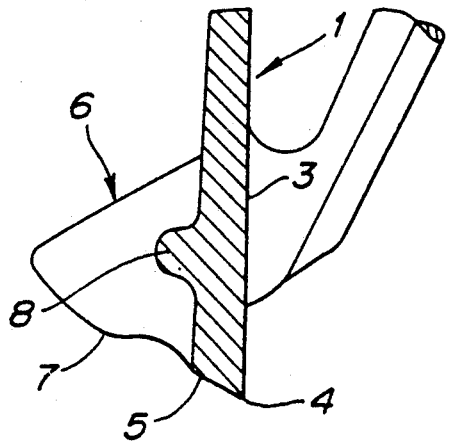
FIG. 2 is a cross-sectional view of the clubhead taken along the line II—II in FIG. 1.
Figure 3:
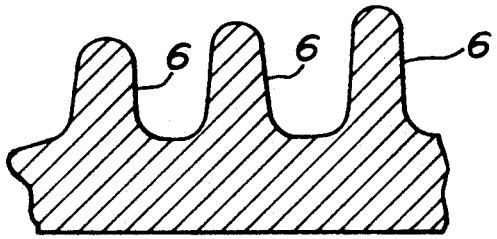
FIG. 3 is a fragmentary cross-sectional view of the clubhead taken along the line III—III in FIG. 1.

FIGS. 1 to 3 illustrate a first embodiment of a clubhead for a golf iron club according to the present invention. Referring to these figures, the clubhead comprises a head body 1 which has a face, back and sole, and heel and toe ends. The clubhead also comprises a neck or hosel 2 which is formed in one piece with the head body 1 at the heel end. The face of the head body 1 is formed of an inclined surface with a loft which varies regularly with club numbers in a set of iron clubs. As best shown in FIG. 2, the head body 1 is formed at the intersection of the face and the sole thereof with a knife-edged leading edge 4. The clubhead having the knife-edged leading edge 4 can be clearly identified from conventional iron clubs which have a rounded leading edge.

By making the leading edge 4 of the clubhead in the shape of knife edge, it becomes easy to cut through the grass in a thick rough and thereby to get a ball out of the rough. Further, if a ball exists in a deep divot, it becomes easy to cut through the turf and thereby accurately strike the ball.

In light of the above-described object of the present invention to provide a clubhead which makes it easy to hit a ball in any bad places, such as, in a rough in which the clubhead tends to get resistance from obstacles such as grass, it is desirable to minimize in area the sole 5 of the head body 1 as soon as possible. With respect to this, the sole 5 of the head body 1 is decreased in width from front to back and thus in area, as best shown in FIG. 2.

In the case that the sole 5 of the head body 1 is decreased in area, it is desirable to reinforce the head body 1. In this aspect, the clubhead is further designated as follows.

As shown in FIG. 1, the head body 1 is provided at the back thereof with three vertical ribs 6 which project backward from the head body 1 in parallel to each other. Because the vertical ribs 6 project backward from the head body 1, the depth from the face 3 to the center of gravity of the clubhead is increased, and accordingly, moment of inertia of the clubhead about the center of gravity thereof is increased, thereby preventing rotation of the face 3 at the time of striking a ball. The ribs 6 can make it easy to pass most of the grass in rough through gaps therebetween and thereby to swing the clubhead through in the rough.

Each of the vertical ribs 6 has a bottom side 7 which is formed of successive curved surfaces having certain curvatures, respectively, and is continuously connected to the sole 5 of the head body 1 so as to provide an additional sole on the back of the sole 5 of the head body 1. The additional sole may be formed in the form of bounce sole. Because the additional sole formed by the bottom sides 7 of ribs 6 is continuously connected to the sole 5 of the head body 1, it is possible to decrease contact resistance of the head body 1 against any obstacles such as grass or turf.

As seen from FIG. 3, each of the vertical ribs 6 is decreased in thickness from the root thereof toward the tip. Such configuration of the ribs 6 can make it possible to decrease contact resistance of the clubhead to the ground.

The head body 1 is further provided with a horizontal rib 8 which projects from the back of the head body 1 and extends perpendicularly to the vertical ribs 6. The horizontal rib 8 also serves to reinforce the head body 1. The horizontal rib 8 further serves to control the height from the sole of the head body 1 to the center of gravity of the clubhead by adjusting the height of the rib 8. It is desirable to make the rib 8 in the shape of curved surface so as to prevent the grass passed through the gaps between the vertical ribs 6 from getting wrapped around the horizontal rib 8.

Figure 4:
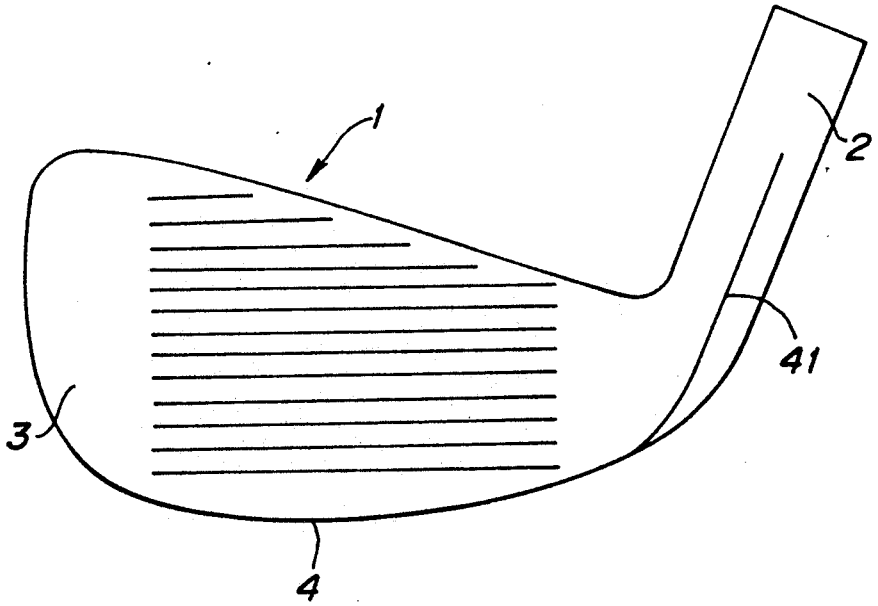
FIG. 4 is a front view of the clubhead shown in FIG. 1.

FIG. 4 shows a second embodiment of the present invention. The same elements as those of the first embodiment shown in FIGS. 1 to 3 are denoted by the same reference numerals in FIG. 4. In the second embodiment, the neck 2 is provided with a knife-edged ridge 41 which projects forward from the front side thereof and is continuously connected to the knife-edged leading edge 4 of the head body 1. The Knife-edged ridge 41 may extend either through the whole length of the neck 2 or through the part of the length thereof. The knife-edged ridge 41 formed on the neck 2 serves to prevent the grass from getting wrapped therearound, thereby making it easy to pass the clubhead through thick rough.

While the invention has been described in conjunction with specific embodiments thereof, it is evident that many alternatives and modifications will be apparent to those skilled in the art in light of the foregoing description. Accordingly, it is intended to include all such alternatives and modifications as fall within the spirit and scope of the appended claims.

What is claimed is:

1. A golf club iron head comprising a head body having an inclined face, a back, a continuous sole extending rearwardly from a bottom of said inclined face to said back, and heel and toe ends, said head body being formed at the intersection of said face and said sole with a continuous knife-edge forming a leading edge of said golf club iron head, said head body having a plurality of vertical ribs projecting rearwardly from a rear of said continuous sole and forming a discontinuous sole at said rear of said continuous sole of said club head, said head body being further provided at said back thereof with a horizontal rib which extends perpendicularly to said vertical ribs.

* * * * *